US007101270B2

(12) United States Patent
Bau' et al.

(10) Patent No.: US 7,101,270 B2
(45) Date of Patent: Sep. 5, 2006

(54) SANDING MACHINE

(75) Inventors: Eligio Bau', Breganze (IT); Nevio Zanuso, Cavazzale (IT)

(73) Assignee: Costa Levigatrici SpA, Schio (IT)

( * ) Notice: Subject to any disclaimer, the term of this patent is extended or adjusted under 35 U.S.C. 154(b) by 0 days.

(21) Appl. No.: 10/511,330

(22) PCT Filed: Apr. 29, 2003

(86) PCT No.: PCT/EP03/04474

§ 371 (c)(1),
(2), (4) Date: Jan. 5, 2005

(87) PCT Pub. No.: WO03/092956

PCT Pub. Date: Nov. 13, 2003

(65) Prior Publication Data

US 2005/0164614 A1 Jul. 28, 2005

(30) Foreign Application Priority Data

May 2, 2002 (IT) ..... VI2002A0080

(51) Int. Cl.
*B24B 7/00* (2006.01)

(52) U.S. Cl. ..... 451/271

(58) Field of Classification Search ..... 451/271; 15/35, 77

See application file for complete search history.

(56) References Cited

U.S. PATENT DOCUMENTS 1,732,695 A * 10/1929 Platt ..... 451/160
1,872,694 A * 8/1932 Drake ..... 451/271
2,420,876 A * 5/1947 Freud ..... 451/211
2,865,142 A * 12/1958 Dunipace et al. ..... 451/271
2,946,087 A * 7/1960 Haroldson et al. ..... 264/280
2,948,087 A 8/1960 Caton
3,208,187 A * 9/1965 Ernst ..... 451/184
3,229,423 A 1/1966 Wilmot
4,615,146 A * 10/1986 Tassoni ..... 451/211
5,339,596 A * 8/1994 Cohen ..... 53/136.3

FOREIGN PATENT DOCUMENTS

| | | |
|---|---|---|
| BE | 1002363 | 1/1991 |
| EP | 0 336 058 | 10/1989 |
| EP | 0 499 334 | 8/1992 |

* cited by examiner

*Primary Examiner*—M. Rachuba
(74) *Attorney, Agent, or Firm*—Dykema Gossett PLLC

(57) ABSTRACT

A sanding machine (1; 300) comprising a support structure (2; 302) for the piece (3) to be processed and a sanding unit (4) for the piece (3) itself. The sanding unit (4) comprises a frame (40) that supports a winding element (8) cooperating with kinematic means (9) suitable for setting it in motion according to a closed ring configuration on a plane ($\pi$1) substantially parallel to the plane ($\pi$2) defined by the support structure (2; 302) and a plurality of abrasive elements (10) combined with the winding element (8) spaced from one another and provided with an abrasive surface (16; 416) that comes in contact with the piece (3) during the movement of the winding element (8).

14 Claims, 8 Drawing Sheets

20
21
14
18
3
3b
3a
19
16
17
8
14

20
21
14
18
3b
3
3c
3e
3d
19
16
17
14

20
21
14
18
3
3c
19

SANDING MACHINE

The invention concerns a sanding machine particularly suitable for being used in the surface processing of panels, doors, furniture doors and similar parts.

This type of processing is generally carried out on raw or painted wood-based materials, but in different applications it can be adopted also for different materials, like plastic or metal, to work on corners or to remove the residues of previous processing.

For this purpose automated sanding machines are known, in which appropriate abrasive elements with suitable grain are placed in contact with the surface of the piece to be sanded.

The abrasive elements are generally constituted by abrasive paper strips closed to form a ring and rotating on a pair of pulleys.

A particular type of machines normally used for sanding low relief surfaces involves the use of abrasive brushes comprising a plurality of abrasive tapes, usually interchangeable, applied to the outer surface of a rotating roller.

During operation these brushes are placed in contact with the piece to be sanded, which is set in motion by a conveyor belt on which it is fixed.

The adhesion of the piece to the conveyor belt is guaranteed by the action of suitable pressing elements that press the piece, as well as by the holding effect obtained by means of a suction unit positioned on the surface of the conveyor belt.

The piece to be sanded is set in motion by the conveyor belt substantially in one direction only with respect to the abrasive brushes that, being usually positioned over the conveyor belt, determine the sanding of one side only of the piece to be sanded, usually the visible upper surface.

Obviously, to carry out a complete sanding of all the sides of the piece, including the edges, it is necessary to carry out successive processing steps, including coordinated movements of the abrasive brushes along different axes, or the rotation of the piece so as to position the sides to be sanded in contact with the brushes.

In different applications, to sand the lateral profiles of the piece the machine is provided with a further sanding unit, where the abrasive brushes of the type described above are arranged vertically, so that they can be placed in contact with the side edge of the piece.

A first drawback of these techniques is represented by the fact that the complete sanding of the piece requires several processing cycles.

Another drawback of these techniques is constituted by the fact that the pressure exerted by the abrasive brushes during their rotation may affect the quality of the processing in small pieces, in fact it is difficult for the pressing element to keep the piece adherent to the conveyor belt, due to the dimensions of the brushes themselves.

The aim of this invention is to overcome the drawbacks described above.

One of the main aims of the invention is to manufacture a sanding machine with which a piece can be sanded with a single processing cycle.

Another aim of the invention is to manufacture a sanding machine that is capable of sanding a piece ensuring a higher quality compared to the equivalent machines of the known types.

A further aim of the invention is to manufacture a sanding machine requiring simplified maintenance operations compared to machines of the known types.

The aims described above have been achieved through the implementation of a sanding machine that, according to the contents of the main claim, is of the type comprising a support structure for the piece to be processed and a sanding unit for sanding said piece, characterized in that said sanding unit comprises a frame supporting:

- at least one winding element cooperating with kinematic means suitable for setting it in motion according to a closed-ring configuration on a plane that is substantially parallel to the plane defined by said support structure;
- a plurality of abrasive elements combined with said winding element, positioned spaced from one another and provided with at least one abrasive surface suitable for coming in contact with said piece during the movement of said winding element.

According to a favourite application of the invention, the winding element is constituted by a closed belt wound between two pulleys, one of which is motor driven.

Each abrasive element is constituted by a laminar abrasive element connected with the belt by means of a shaft positioned substantially perpendicular to the plane defined by the support structure.

To advantage, along their trajectory the abrasive elements sequentially involve the side edges of the piece and its visible upper surface, thus carrying out the complete sanding of the piece.

The aims and advantages mentioned above will be better highlighted by the description of some among many possible applications of the invention in question, with reference to the enclosed drawings, wherein.

Figure 1:
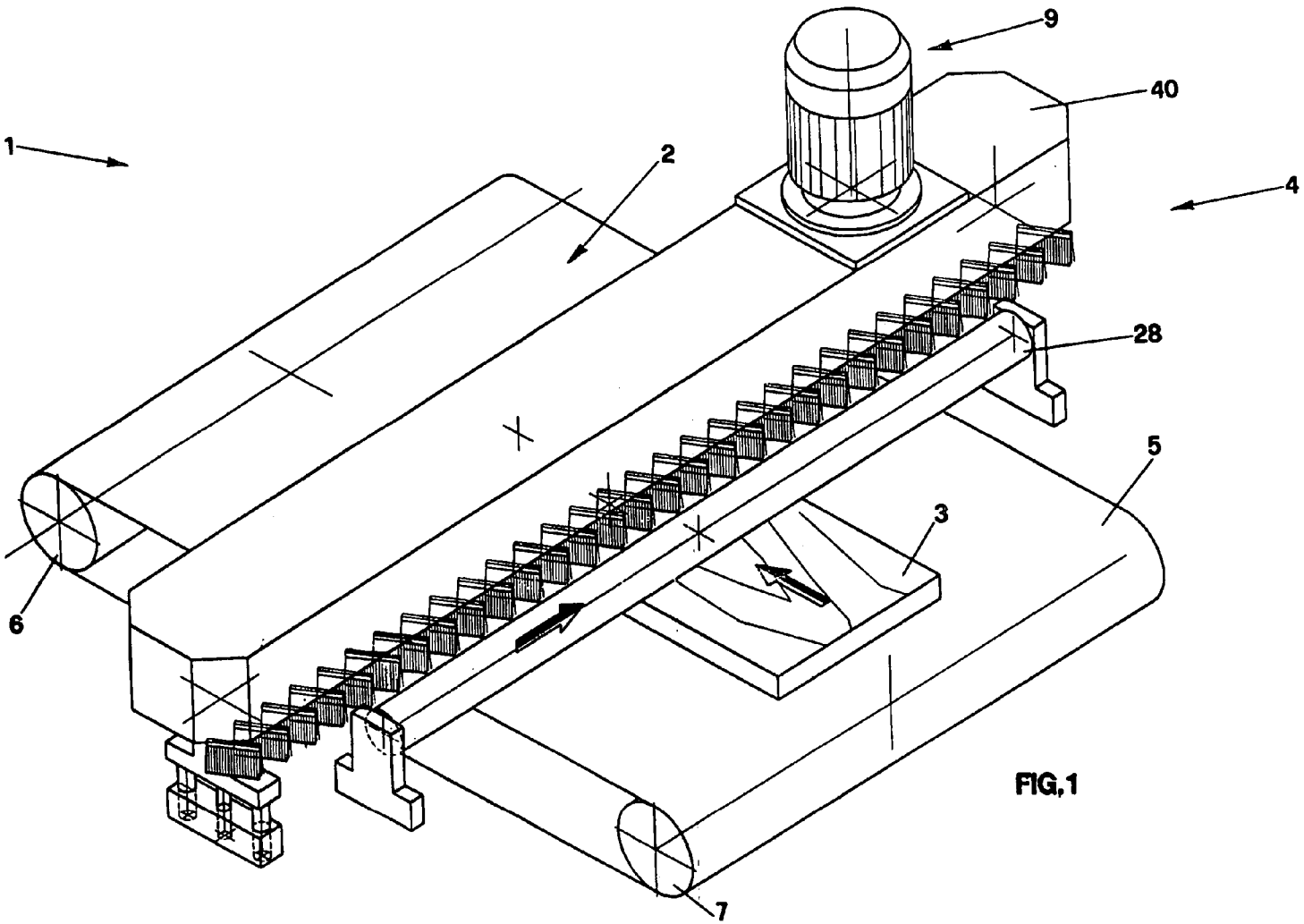
FIG. 1 is an axonometric view of the sanding machine object of the invention.
Figure 7:
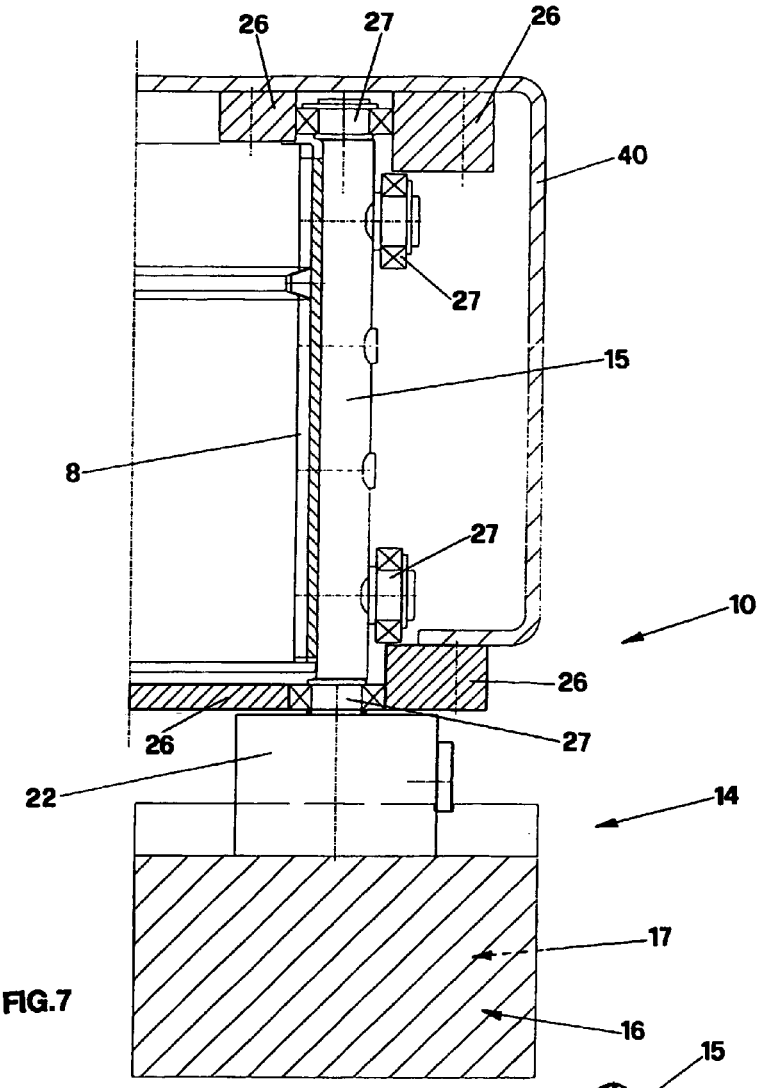
Figure 8:
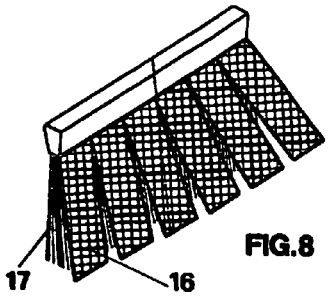
Figure 9:
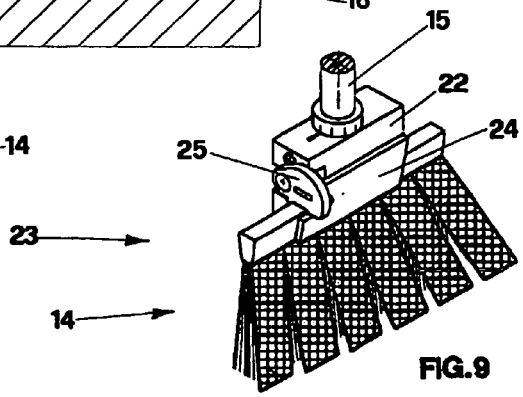
Figure 10:
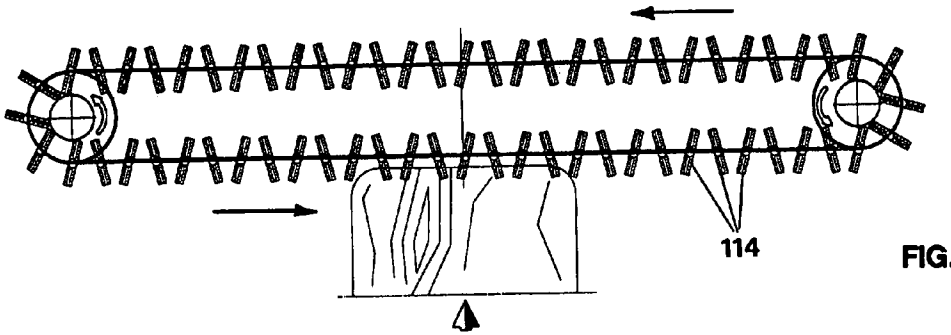
Figure 11:
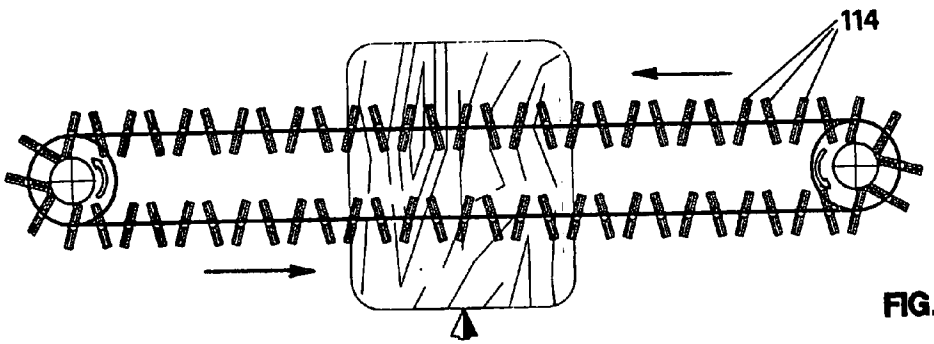
Figure 12:
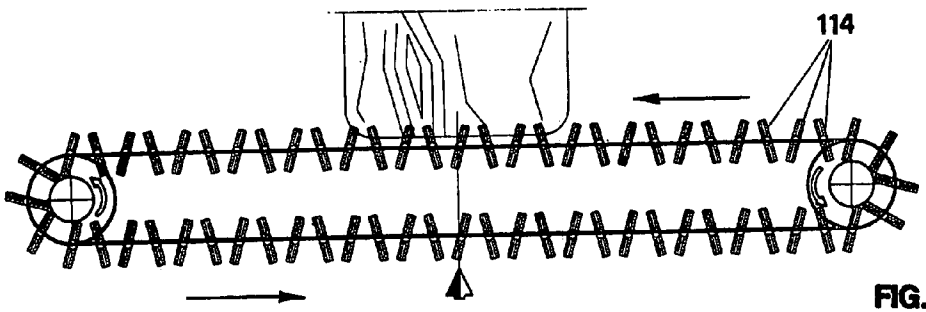
Figure 13:
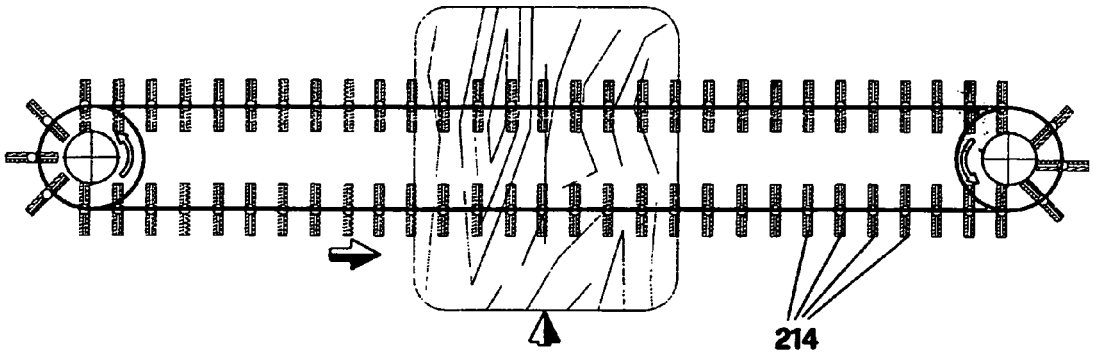
Figure 15:
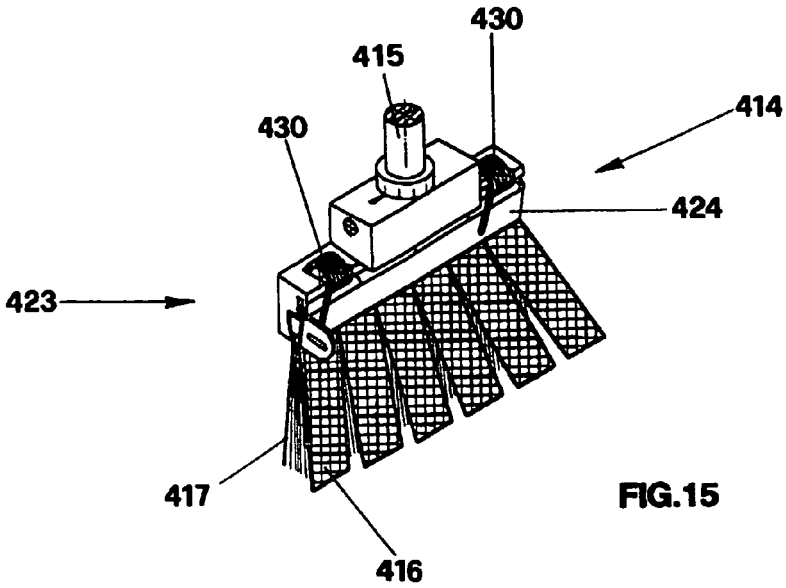
Figure 14:
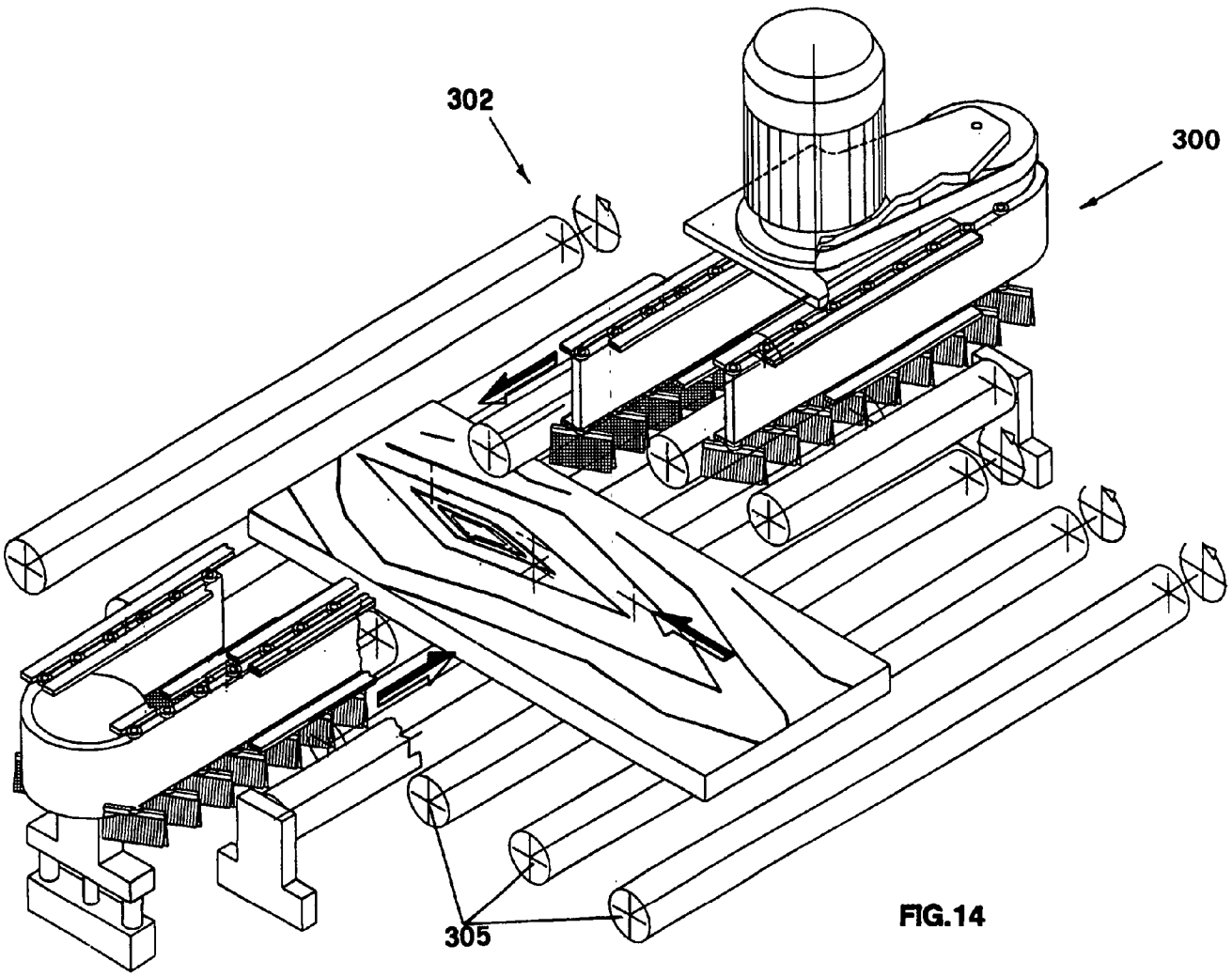

FIGS. from 4 to 6 are schematic top views of the machine object of the invention in different piece processing phases;

FIG. 7 shows a cross-section of an enlarged detail of FIG. 1;

FIG. 8 is an axonometric view of a detail of an abrasive element;

FIG. 9 is an axonometric view of a detail of FIG. 7;

FIGS. from 10 to 12 show a schematic top view of a variant of the machine object of the invention in different piece processing phases;

FIG. 13 is a schematic top view of another variant of the invention;

FIG. 14 is an axonometric view with a partial cross section of a further variant of the invention;

FIG. 15 shows a variant of FIG. 9.

The sanding machine object of the invention is shown in FIG. 1, where it is indicated as a whole by 1.

It substantially comprises a support structure 2 for the piece 3 to be worked and a sanding unit, indicated as a whole by 4, for sanding the piece 3.

In the application of FIG. 1 the support structure 2 is movable with respect to the sanding unit 4 and substantially comprises a conveyor belt 5 wound to form a closed ring between a pair of rotating cylinders 6, 7.

In different applications the relative movement between the sanding unit 4 and the support structure 2 can be obtained, for example, by moving the sanding unit 4 only.

Figure 2:
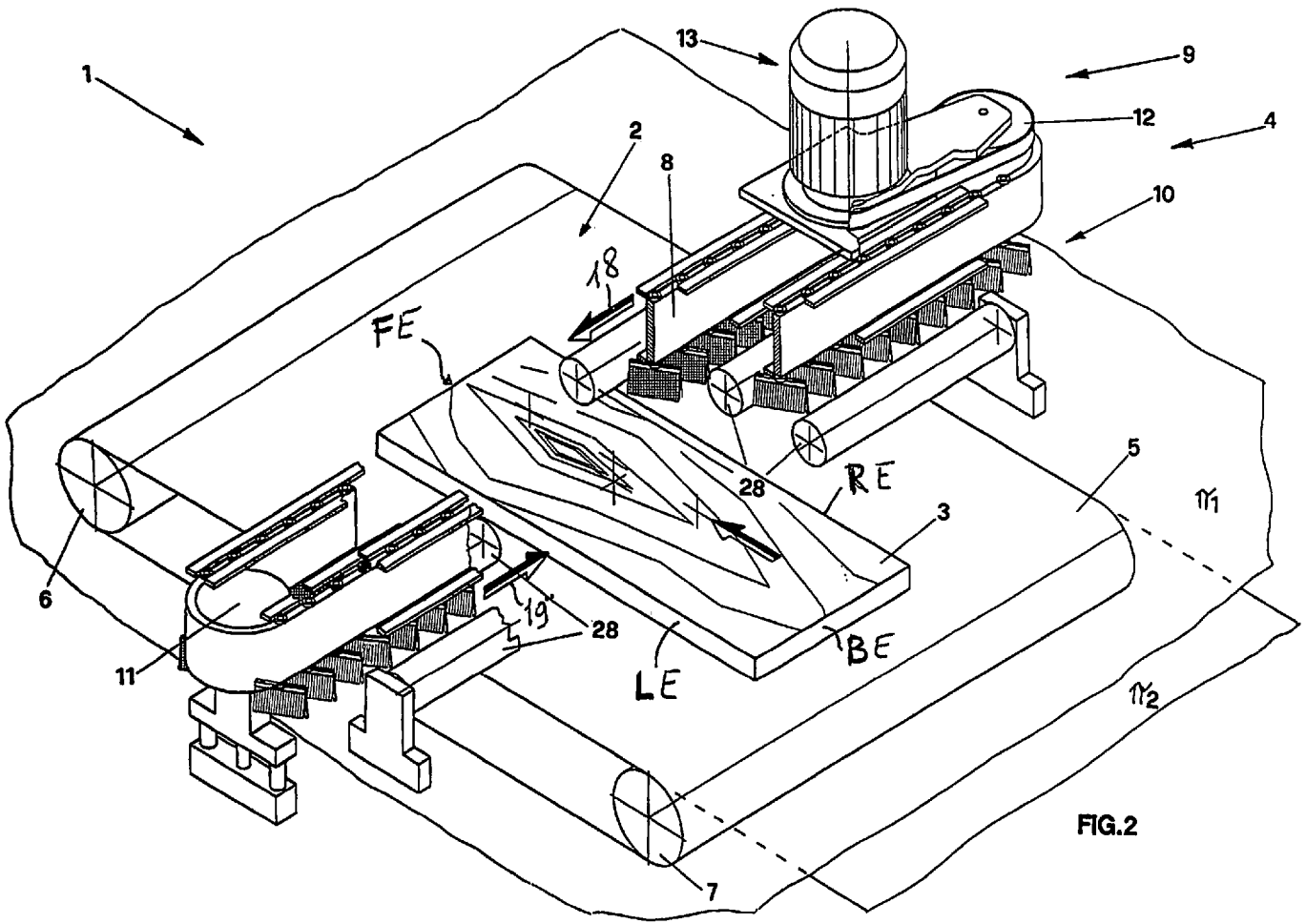
FIG. 2 shows a partial cross-section of FIG. 1.
Figure 3:
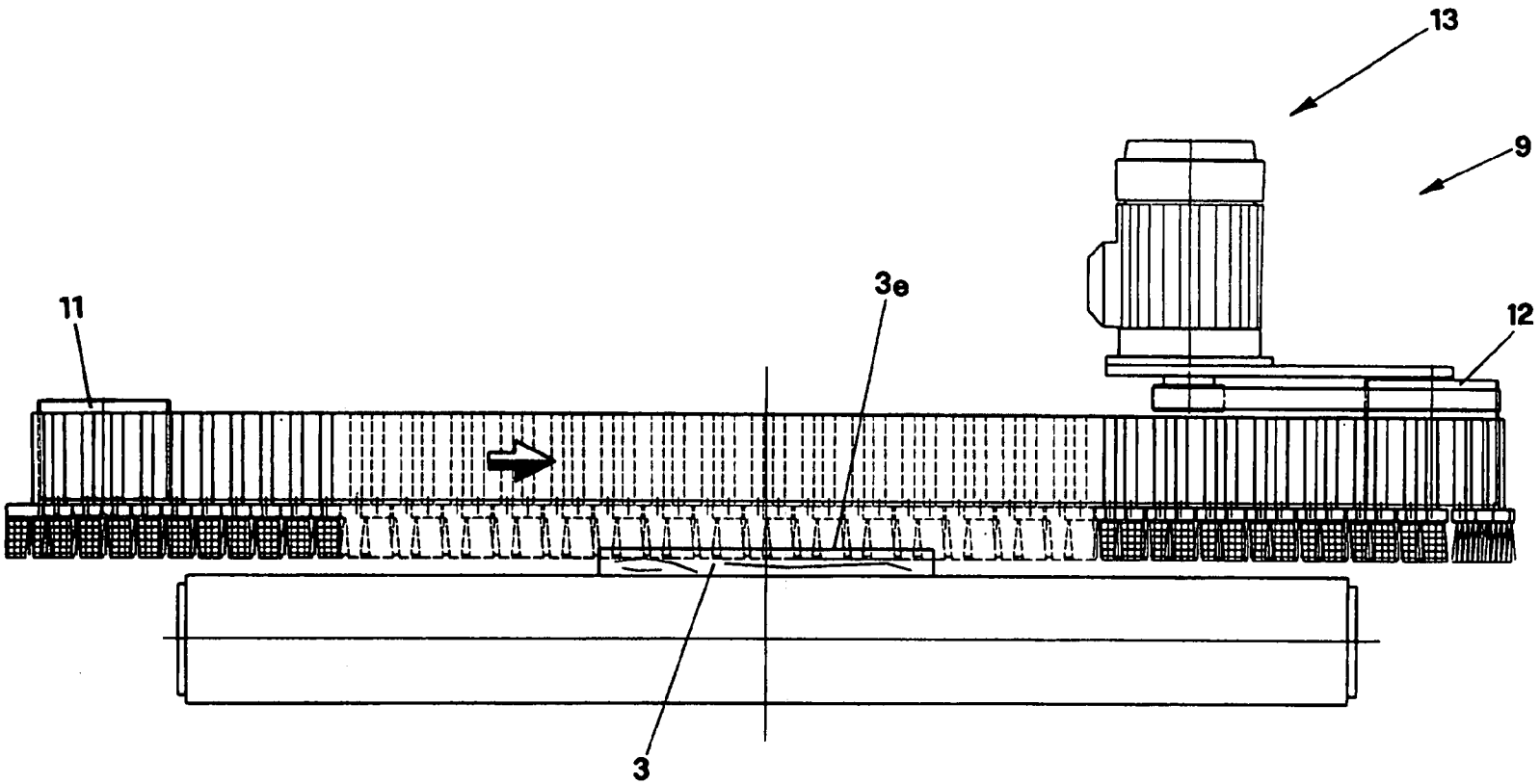
FIG. 3 is a side view of FIG. 1.

According to the invention, the sanding unit 4 comprises a frame 40 supporting a winding element 8, as can be seen in greater detail in FIG. 2, cooperating with kinematic means, indicated as a whole by 9, and a plurality of abrasive elements 10, combined with the winding element 8 and arranged spaced from one another along the development of the winding element 8 itself.

In particular, the winding element 8 assumes a closed ring configuration on a plane π1 substantially parallel to the plane π2 defined by the support structure 2.

For convenience's sake said planes π1 and π2 are positioned horizontally, but it is clear that in different applications they can have any position, even inclined. As to the winding element 8, it is constituted by a belt closed to form a ring and cooperating, as already said, with the kinematic means 9 that set it rotating on plane π1.

The kinematic means 9 are constituted by two pulleys 11, 12, between which the winding element 8 is wound and by motorization means, indicated as a whole by 13, mechanically connected with one of said pulleys, in the case represented in the figure with pulley 12, to set it rotating.

Each one of the abrasive elements 10, as shown in FIG. 7, is constituted by a laminar abrasive element 14 connected with the winding element 8 by means of a shaft 15 arranged substantially perpendicular to the support structure 2, where the piece to be processed 3 is positioned.

The laminar abrasive element 14, as shown in the detail of FIG. 8, is preferably constituted by abrasive strips of the known type, comprising a piece of abrasive paper 16, on which a series of fringes is obtained.

The abrasive paper 16 is positioned at the side of a series of fibrous element 17 that, owing to their intrinsic elasticity, determine the flexibility of the laminar abrasive element 14 itself.

As shown in the figures, and in particular in the top views of the FIGS. from 4 to 6, each laminar abrasive element 14 is positioned inclined with respect to the advance directions of the winding element 8, indicated by the arrows 18 and 19, with respect to the two main sides 20, 21 on which the winding element 8 itself is wound.

This inclination, in fact, ensures the soft aggression of the corners of the piece 3 with which the laminar abrasive elements come in contact.

The laminar abrasive element 14 clearly has the abrasive paper 16 positioned at the front and the fibrous elements 17 positioned at the rear with respect to the advance directions of the winding element 8.

To allow each laminar abrasive element 14 to be arranged in an inclined position, the shaft 15 is provided with articulation means, indicated as a whole by 22, that make it possible to define, as we shall see later on, suitable and different inclined positions of the laminar abrasive element 14.

The articulation means 22 can be carried out according to known techniques commonly used in the mechanical sector.

To facilitate maintenance operations and the replacement of the laminar abrasive elements 14, the same are advantageously joined to their respective support shaft 15 so that they can be removed, thus ensuring easy and quick replacement.

This is highlighted in FIG. 9, where it can be observed that the laminar abrasive element 14 is removably constrained to the support shaft 15 through holding means, indicated as a whole by 23, constituted by a movable plate 24 positioned against the laminar abrasive element 14 through the operation of a pawl 25.

To facilitate the guided movement of the abrasive elements 10 on the frame 40 guide means are provided, indicated by 26 in FIG. 7, substantially constituted by rails that develop at least for part of the length of the winding element 8 and slidingly receive the shaft 15 of the abrasive element 10.

In particular, the shaft 15 is combined with rolling sliding means 27 that, cooperating with the rails 26, guide the abrasive elements 10, thus reducing the stress on the winding element 8 and reducing the oscillation of the winding element 8 to the minimum.

To advantage, said guide means 26 will develop for a width corresponding to the maximum width admissible for the pieces to be processed.

Combined with the sanding unit 4, as it can be observed in detail in FIG. 2, there are pressing elements, indicated as a whole by 28, constituted by rollers that during the sanding process are positioned in such a way as to adhere to the piece to be processed 3 and facilitate its adhesion to the support structure 2.

Furthermore, the support structure 2 may be provided with suction means, not represented in the figure for simplicity's sake and in any case already known, which further increase the adhesion of the piece 3.

Figures 4, 5, 6:
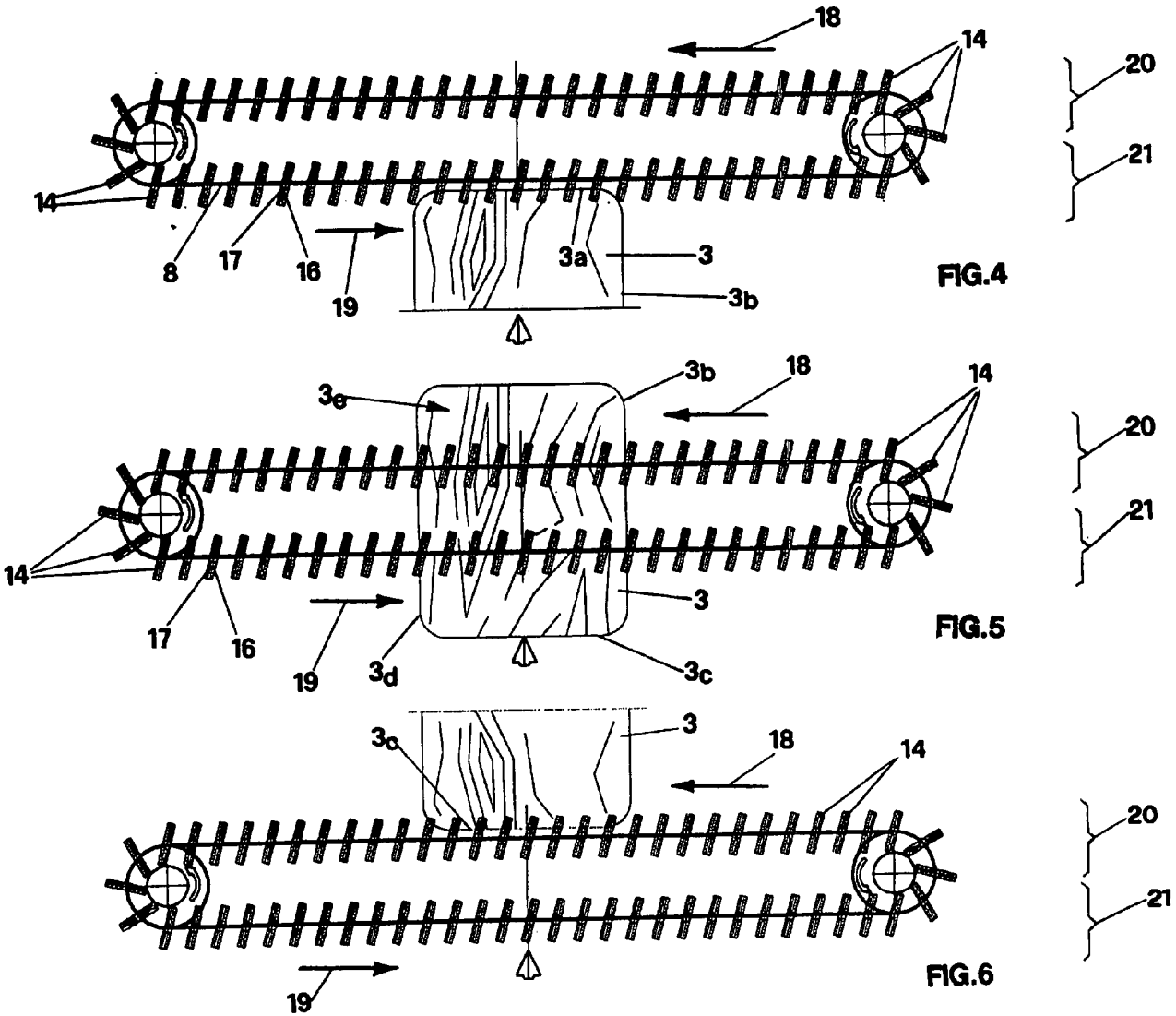

During operation, as shown in FIGS. 4, 5, and 6, the piece to be processed 3 advances in a substantially perpendicular direction with respect to the parallel advance directions 18, 19 of the winding element 8.

When at the beginning of the cycle the piece 3 comes in contact with the abrasive elements 10, as shown in detail in FIG. 4, the laminar abrasive elements 14 of the main side 21 come in contact with the front side edge 3*a* of the piece 3, thus sanding this edge.

Successively the piece 3 advances further and, as can be observed in FIG. 5, comes in contact with the abrasive elements 14 of both sides 20, 21.

In particular, the abrasive elements 14 of the side 20 come in contact with the side edge 3*b* and the visible upper surface 3*e* of the piece 3.

Analogously, the abrasive elements 14 of the side 21 come in contact with the side edge 3*d* and the same visible surface 3*e*.

In the last sanding phase, as shown in FIG. 6, the abrasive elements 14 of the main row 20 come in contact with the last side edge 3*c* that hasn't been sanded yet, thus finishing the processing of the piece 3.

It is clear that, independently of the shape of the piece to be sanded, all its side edges, as well as its visible surface are sanded in a single processing cycle.

It is also clear that during the processing phases the pressing elements 28, not represented in the FIGS. from 4 to 6 for simplicity's sake, will be advantageously rested on the upper surface 3*e* of the piece 3, in order to keep it adherent to the conveyor belt 5.

It is important to point out that, compared to the known types of sanding machines, in this case the pressing elements 28 can be arranged at a shorter distance from one another, thus ensuring optimal adhesion also for small pieces.

In case of application to more sophisticated sanding machines, a sanding unit 4 of the type described above may also be advantageously combined with traditional sanding units, for example sanding units with rotary brushes.

The FIGS. from 10 to 12 schematically show a variant of the sanding machine object of the invention during different processing phases; it differs from the previous one for the different inclination of the laminar abrasive elements 114.

Said abrasive elements, as it can be observed, are inclined according to an alternate configuration that, compared to the previous application, ensures compensated distribution of stresses on the winding element, due to the contact of the laminar abrasive elements 114 with the piece to be processed.

In this way the oscillation of the winding element during its rotation can be further reduced and the construction of the sanding machine may be simplified, since there is no need for guide means combined with the shaft of each abrasive element.

FIG. 13 shows a further variant of the invention, which differs from the previous applications described above for the different arrangement of the laminar abrasive elements 214 that, in this case, are perpendicular to the advance directions of the winding element.

FIG. 14 shows a further variant of the invention, indicated as a whole by 300. It differs from the first practical application for the different construction of the support structure 302, which in this case is constituted by a plurality of rotating rollers 305 positioned side by side which, while rotating, bring with themselves the piece to be processed that rests upon them.

Finally, FIG. 15 shows a different construction of the holding means 423 of the laminar abrasive element 414, comprising a movable plate 424 positioned against the laminar abrasive element 414 owing to the action of a pair of lateral springs 430 that are integral with the shaft 415.

In this case the laminar abrasive element 414 can advantageously comprise is two distinct parts 416, 417, the first part 416 being constituted by the abrasive paper and the second part 417 being constituted by fibrous elements.

With this configuration, maintenance operations may require the replacement of the worn abrasive paper 416 only, with no need to replace also the fibrous elements 417.

The above clearly shows that the sanding machine object of the invention, in the different variants illustrated and described herein, achieves the aims set and offers the advantages described.

Upon implementation, further modifications that are not described and represented herein may be made on the machine object of the invention.

Said modifications may be constituted, for example, by a different position of the winding element, by a different execution of the same, for example with ring chains wound on gear wheels, or again by a different execution of the laminar abrasive elements and a different method to apply them to the winding element itself.

These and other variants, not described and not represented herein, must all be considered protected by this patent, provided that they are included in the innovative concepts expressed in the following claims.

What is claimed is:

1. A sanding machine for processing a workpiece comprising:

a support structure defining a plane for supporting the workpiece for movement in a first direction;

a frame;

kinematic mean secured to the frame;

at least one sanding unit for processing said workpiece, including a winding element cooperating with the kinematic means for movement in a closed ring configuration, said closed ring configuration being oriented in plane substantially parallel to the plane defined by said support structure;

a plurality of laminar abrasive elements each secured to the winding element in spaced apart relation thereal-ong, said abrasive elements being, disposed substantially perpendicular to the plane of said support structure and moveable with the winding element for engaging the workpiece in two parallel advance spaced apart linear directions transverse to the first direction, a shaft for securing each laminar element to the winding element in a direction substantially perpendicular to said plane defined by said support structure, each abrasive element being secured to a corresponding shaft such that the abrasive element is disposed at a fixed incline with respect to the advance directions of said winding element while engaging the workpiece.

2. The sanding machine according to claim 1 wherein said kinematic means of said winding element comprises at least two pulleys between which said winding element is wound and motorization means cooperating with at least one of said pulleys to set it rotating.

3. The sanding machine according to claim 1 wherein said laminar abrasive element is removably connected with said shaft through holding means.

4. The sanding machine according to claim 3 wherein said holding means comprise at least one moving plate suitable for being placed against the laminar abrasive element through the operation of a pawl.

5. The sanding machine according to claim 3 wherein said holding means comprise at least one moving plate suitable for being placed against the laminar abrasive element through the action of at least one spring integral with said shaft.

6. The sanding machine according to claim 1 wherein said shaft comprises articulation means suitable for defining said inclined position of said laminar abrasive element.

7. The sanding machine according to claim 1 comprising guide means combined with said frame, suitable for slidingly receiving said shaft for at least one section during its movement.

8. The sanding machine according to claim 7 wherein said guide means comprise at least one track integral with said frame and are suitable for receiving rolling sliding means combined with said shaft.

9. The sanding machine according to claim 1 wherein said support structure can be moved with respect to said sanding unit.

10. The sanding machine according to claim 1 wherein said support structure comprises a conveyor belt closed to form a ring between at least one pair of rotating cylinders.

11. The sanding machine according to claim 1 wherein said support structure comprises a plurality of rotating rollers positioned side by side.

12. The sanding machine according to claim 1 wherein said sanding unit can be moved with respect to said support structure.

13. The sanding machine according to claim 1 comprising suction means combined with said support structure and suitable for keeping said piece adherent to said support structure.

14. The sanding machine according to claim 1 comprising one or more pressing elements combined with said frame, suitable for being placed in contact with said piece to keep it adherent to said support structure.

* * * * *